US005184756A

United States Patent [19]

Amron

[11] Patent Number: 5,184,756

[45] Date of Patent: Feb. 9, 1993

[54] FLYWHEEL WATER GUN

[75] Inventor: Alan B. Amron, Syosset, N.Y.

[73] Assignee: Talk To Me Products, Inc., Syosset, N.Y.

[21] Appl. No.: 732,213

[22] Filed: Jul. 18, 1991

[51] Int. Cl.[5] ..... A63H 3/17

[52] U.S. Cl. ..... 222/79; 222/400.8; 222/401; 446/473

[58] Field of Search ..... 222/79, 400.8, 401, 222/325, 396; 42/54; 273/349; 446/473; 417/415; 239/351, 526, 355, 373

[56] References Cited

U.S. PATENT DOCUMENTS

| | | | |
|---|---|---|---|
| 2,589,977 | 3/1952 | Stelzer | 222/401 X |
| 2,746,643 | 5/1956 | Spalding | 222/79 |
| 4,114,311 | 9/1978 | Chow | 42/54 X |
| 4,743,030 | 5/1988 | Auer et al. | 273/349 |
| 4,750,641 | 6/1988 | Chin-Fu | 222/79 |
| 4,757,946 | 7/1988 | Johnson | 446/473 X |
| 5,074,437 | 12/1991 | D'Andrade et al. | 222/79 |

FOREIGN PATENT DOCUMENTS

| | | | |
|---|---|---|---|
| 669983 | 4/1952 | United Kingdom | 222/79 |

*Primary Examiner*—Gregory L. Huson
*Attorney, Agent, or Firm*—Gerard F. Dunne

[57] ABSTRACT

A water gun having a water reservior adapted to be partially filed with water includes a piston pump having an outlet connected to the water reservior. A hand-operated slide member can be reciprocated by an operator for the water gun, and a rack connected to the slide member drives a gear train connected to a flywheel. The flywheel is connected through a crank wheel to the piston of the piston pump, and as the operator withdraws the slide member to rotate the flywheel, the piston is reciprocated back and forth within the piston chamber of the pump to drive air into the water reservior. The flywheel maintains the reciprocating motion of the piston as the operator slides the slide member forward in preparation for another stroke. In this way, the pumping action is maintained by the flywheel as the operator reciprocates the slide member forward to begin another stroke.

4 Claims, 2 Drawing Sheets

FLYWHEEL WATER GUN

The present invention relates to a water gun having a flywheel connected to a piston pump and driven by the stroke of a slide member. The flywheel maintains the reciprocating movement of the piston within the piston pump during the forward stroke of the slide member.

Water guns are known which include a water reservoir which is partially filed with water and can be pressurized by actuation of a piston pump. A trigger is provided to release water from the water reservoir through a nozzle of the water gun after the operator has actuated the piston pump to force sufficient pressure within the water reservoir.

An object of the present invention is to increase the efficiency of such hand-pumped water guns. According to the present invention, a water gun has a water reservoir adapted to receive water and a pump formed by a piston adapted to be reciprocated in a piston chamber. An outlet of the pump is connected to the water reservoir, and a hand-operated slide member is adapted to be reciprocated by an operator. A flywheel is connected between the slide member and the piston of the piston pump for reciprocating the piston pump within the chamber upon rotation of the flywheel. Preferably, the slide member carries a rack connected to means including a gear train to rotate the flywheel upon the rearward stroke of the slide member, and the flywheel will continue to rotate to reciprocate the piston within the piston chamber of the pump during the forward stroke of the slide member.

These and other objects, features and advantages of the present invention will become better understood from discussions of a detail embodiment thereof, made in connection with the following drawings, in which.

Figure 1:
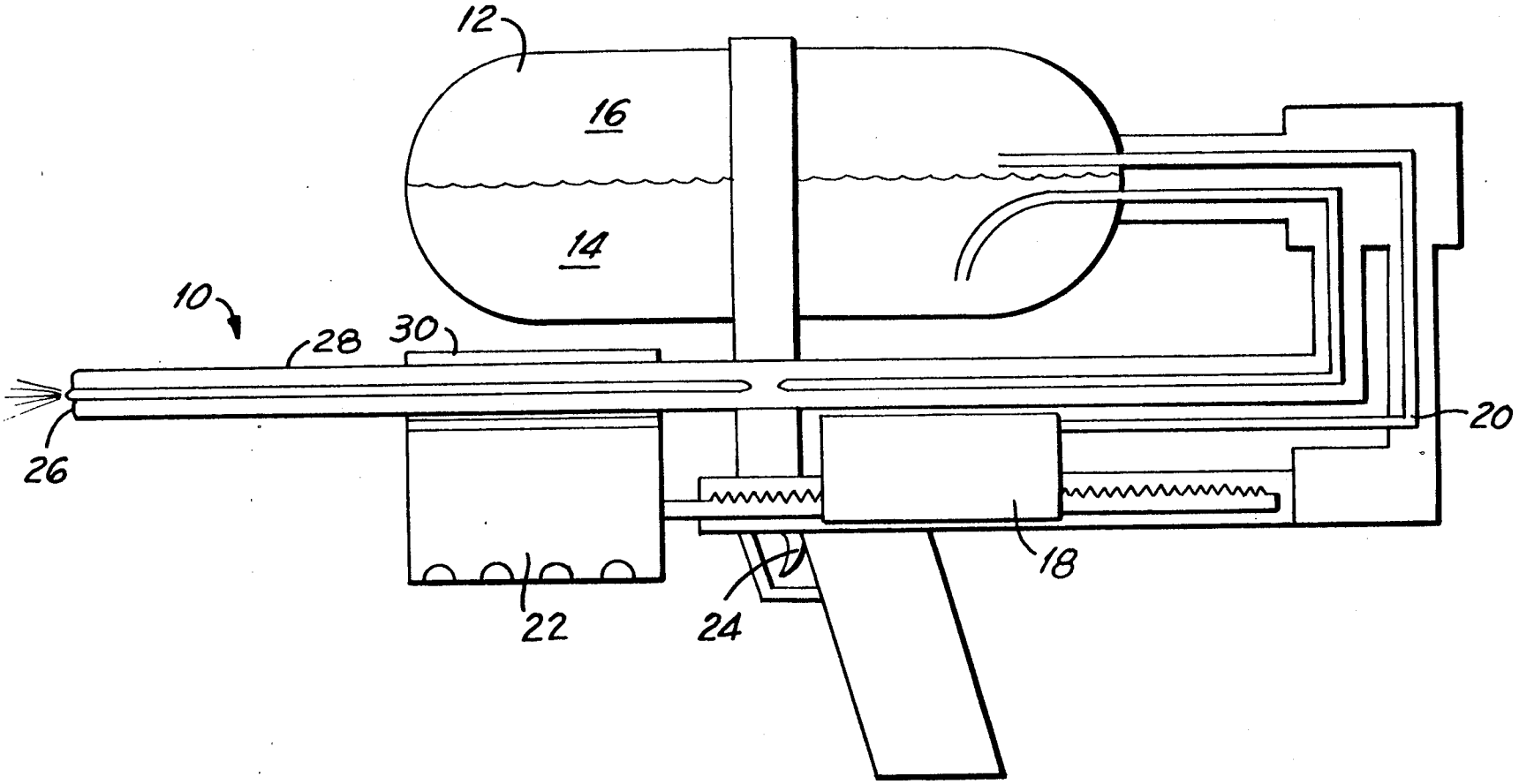
FIG. 1 is a schematic illustration of a water gun according to the present invention.

As illustrated in FIG. 1, a water gun 10 includes a water reservoir 12 which may be partially filled with water 14 to provide an air space 16. A pumping mechanism 18 is provided which drives air from an outlet conduit 20 into the air chamber of the water reservoir to increase the pressure there within. A hand grip 22 serves as a slide member for actuating the pump 18. After the pressure has been sufficiently increased by pumping air into the water reservoir 12, a trigger mechanism 24 can be actuated to release water under pressure from the water reservoir 12 through the eject nozzle 26 of the water gun.

The grip 22 is connected for reciprocal movement along the barrel 28 of the water gun by slide member 30 shown in section in FIG. 1.

Figure 2:
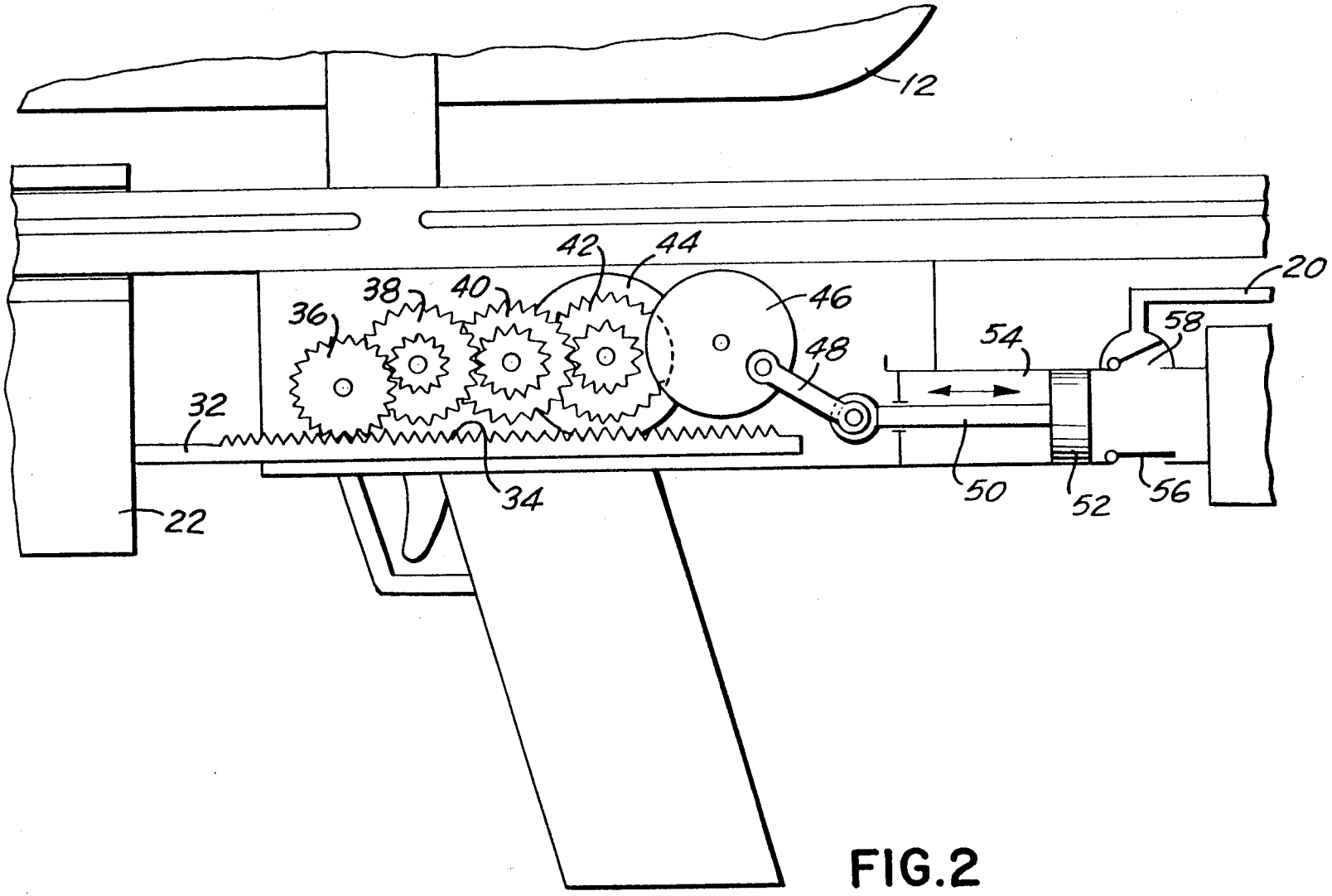
FIG. 2 is a schematic illustration showing the details of the flywheel-drive for the piston pump.

As illustrated in FIG. 2, the grip 22 is connected rigidly to a rack 32 having rearwardly inclined gear teeth 34. The gear teeth 34 of the rack 32 are connected to the gear train formed by the respective gears 36, 38, 40 and 42. The last gear 42 within the gear train is connected through a one-way slip clutch to a flywheel 44. Flywheel 44 is connected to crank wheel 46 having a crank arm 48 connected to the shaft 50 of the piston 52 reciprocating within piston chamber 54. As the piston 52 is withdrawn forwardly within the piston chamber 54, ambient air enters the piston chamber through one-way inlet valve 56; and as the piston is forced rearwardly air pressurized within the piston chamber exits through one-way outlet valve 58 into conduit 20 leading to the air chamber 16 within water reservoir 12.

In operation, an operator grips the grip member 22 and forces the slide member rearwardly through a stroke which causes the gear train to rotate the flywheel at a relatively high speed. The gear train serves to rotate the flywheel 44 through one complete turn during each inch of linear movement of the rack 32, and completion of a full stroke causes the flywheel 44 to rotate rapidly to turn the crank wheel 46 and reciprocate the piston 52 rapidly within the chamber 54. As will be understood, during the forward stoke of the grip member 22, the slip clutch between the flywheel and the gear train enable the flywheel to continue its rotation to turn the crank wheel 46 and reciprocate the piston 52 within the piston chamber 54. In this way, the piston will continue its pumping of air into the water reservoir even during the forward stroke of the grip member 22.

Additionally, as the grip member is withdrawn for another stroke, the flywheel will again be engaged through the slip clutch with the gear train to increase its rotational speed with each rearward stroke of the slide member 22. In this way, the pumping mechanism can be actuated at a faster and faster rate during repeated strokes of the slide member 22 to force air into the water reservoir 12 at a high rate of efficiency.

The present invention has been described in connection with an embodiment thereof, but the scope of the present invention is not intended to be limited by any of the details of the embodiment described above. The scope of the present invention is intended to be set forth below in the appended claims.

What is claimed is:

1. A water gun having a water reservoir adapted to receive water, a pump having a piston adapted to be reciprocated in a piston chamber, an outlet conduit connecting an outlet of said piston chamber to said water reservoir, a hand-operated member adapted to be actuated by an operator to a first position, means including a flywheel connected between said member and the piston of said piston pump for reciprocating said piston within said piston chamber upon actuation of said member to said first position and to maintain momentum to continue to reciprocate said piston upon return of said member from said first position.

2. A water gun as set forth in claim 1, said means including a rack connected to said member and means including a gear train connected between said rack and said flywheel for rotating said flywheel upon sliding movement of said member.

3. A water gun as set forth in claim 2, further including a crank wheel connected between said flywheel and said piston.

4. A water gun as set forth in claim 2, said flywheel being connected to said gear train by a one-way slip clutch.

* * * * *